US010762881B2

(12) United States Patent
Rolland

(10) Patent No.: US 10,762,881 B2
(45) Date of Patent: Sep. 1, 2020

(54) BOW FOR STRINGED INSTRUMENTS

(71) Applicant: Benoit Rolland, Watertown, MA (US)

(72) Inventor: Benoit Rolland, Watertown, MA (US)

(73) Assignee: Benoit Rolland, Watertown, MA (US)

( * ) Notice: Subject to any disclaimer, the term of this patent is extended or adjusted under 35 U.S.C. 154(b) by 0 days.

(21) Appl. No.: 16/384,304

(22) Filed: Apr. 15, 2019

(65) Prior Publication Data

US 2020/0043449 A1 Feb. 6, 2020

Related U.S. Application Data

(63) Continuation of application No. 15/454,213, filed on Mar. 9, 2017, now Pat. No. 10,262,634, which is a continuation of application No. PCT/US2013/046608, filed on Jun. 19, 2013.

(60) Provisional application No. 61/661,957, filed on Jun. 20, 2012.

(51) Int. Cl.
*G10D 3/16* (2020.01)

(52) U.S. Cl.
CPC ..... *G10D 3/16* (2013.01)

(58) Field of Classification Search
CPC ..... G10D 3/16
See application file for complete search history.

(56) References Cited

U.S. PATENT DOCUMENTS

| | | | | |
|---|---|---|---|---|
| 236,449 A | | 1/1881 | Monroe | |
| 565,395 A | * | 8/1896 | Spitzner | G10D 3/16 84/282 |
| 676,028 A | * | 6/1901 | Conklin | G10D 3/16 84/282 |
| 2,071,894 A | * | 2/1937 | Nurnberger | G10D 3/16 84/282 |
| 2,624,225 A | | 1/1953 | Nebel | |
| 3,122,960 A | | 3/1964 | Stühlen | |
| 3,759,131 A | | 9/1973 | Brock | |
| 3,979,992 A | | 9/1976 | Gandillet | |
| 3,991,647 A | | 11/1976 | Darling | |
| 4,040,322 A | | 8/1977 | Parkyns et al. | |
| 4,713,998 A | | 12/1987 | Weiss | |
| 5,323,675 A | * | 6/1994 | Rolland | G10D 3/16 84/282 |
| 10,262,634 B2 | * | 4/2019 | Rolland | G10D 3/16 |
| 2009/0249937 A1 | | 10/2009 | Bartholomew | |

(Continued)

FOREIGN PATENT DOCUMENTS

KR 191059 B1 6/1999

OTHER PUBLICATIONS

Anonymous, "Unusual Instruments," Apr. 1, 2002 (Apr. 1, 2002); Retrieved from the Internet URL http://www.siegelproductions.ca/fiddlefarmers/unusualinstruments, 65 pages.

(Continued)

*Primary Examiner* — Robert W Horn
(74) *Attorney, Agent, or Firm* — Cooley LLP; Michael S. Tuscan; Katherine Miller

(57) ABSTRACT

A stringed instrument bow includes an elongated stick (102) having a head (110) and a frog (112) holding a ribbon of bow hair (108). The head and frog are configured such that bow hair (108) held under tension between the head and the frog forms a longitudinally twisted ribbon as held.

10 Claims, 4 Drawing Sheets

(56) References Cited

U.S. PATENT DOCUMENTS

| | | | | |
|---|---|---|---|---|
| 2013/0111757 | A1 | 5/2013 | Yamamoto | |
| 2017/0178604 | A1 * | 6/2017 | Rolland | G10D 3/16 |

OTHER PUBLICATIONS

European Examination Report dated Jun. 10, 2016 for European Application No. 13807498.4, 7 pages.
European Search Report dated May 25, 2016 for European Application No. 13807498.4, 5 pages.
International Preliminary Report on Patentability dated Dec. 31, 2014 for International Application No. PCT/US2013/046608, 9 pages.
International Search Report and Written Opinion dated Oct. 1, 2013 for International Application No. PCT/US2013/046608, 12 pages.
Notification of Reasons for Rejection dated Oct. 4, 2016 for Japanese Application No. 2015-518557, with English translation, 6 pages.

* cited by examiner

BOW FOR STRINGED INSTRUMENTS

CROSS-REFERENCE TO RELATED APPLICATIONS

This application is a continuation of U.S. application Ser. No. 15/454,213, filed Mar. 9, 2017 (now U.S. Pat. No. 10,262,634), which is a continuation of, and claims priority to, International Patent Application No. PCT/US2013/046608, filed on Jun. 19, 2013, which claims priority to U.S. Provisional Patent Application No. 61/661,957, filed on Jun. 20, 2012, the entire contents of each of which are incorporated herein by reference.

TECHNICAL FIELD

This invention relates to a bow for use with stringed musical instruments.

BACKGROUND

Various types of stringed instruments are played by stroking the strings of the instrument with a bow, causing sound-emitting vibrations. The conventional bow includes a thin bow-stick equipped with a head and a frog at opposing ends. The head and frog hold a taut ribbon of natural or synthetic bow hair therebetween, at a distance from the body of the stick. Tightening of the ribbon is commonly achieved by adjustment of the position of the frog along the stick, although other means of fiber tightening have been suggested over the years.

SUMMARY

The invention features a stringed instrument bow having, or configured to hold taut, a longitudinally twisted ribbon of bow hair. This arrangement can facilitate an easier and broader use of the bow hair ribbon.

By "bow hair" I refer to any natural (e.g., horsehair) or synthetic strands (e.g., nylon), fibers, or threads that can be held taut on a bow-stick under tension and used to stroke the strings of a musical instrument.

One aspect of the invention features a stringed instrument bow with an elongated stick extending longitudinally between a head end and a frog end. A head coupled to the head end of the stick has a first bow ribbon support surface (e.g., a substantially flat face of the head), and a frog coupled to the frog end of the stick has a second bow ribbon support surface (e.g., a base surface of an elongated groove defined by an underside of the frog). The second bow ribbon support surface is angled with respect to the first bow ribbon support surface, such that a ribbon of bow hair extending taut between and engaging the first and second bow ribbon support surfaces will exhibit a longitudinal twist.

Some examples also include a set of bow hairs held taut between the head and the frog in the form of a twisted ribbon of bow hair.

In some embodiments the twisted ribbon defines a plane twisted about a line that extends between the frog and the head and is contained within the plane.

For many applications, the twisted plane defines a total angle of twist, between the first and second support surfaces, of between about 1 and 45 degrees. In some cases, the angle of twist is about 15 degrees.

In some cases the elongated stick defines a bow plane, and respective centerlines of the frog and the head lie in the bow plane. For some applications, one of the support surfaces is substantially perpendicular to the bow plane.

In many examples the frog is movable along the stick to adjust bow hair tension.

For some applications, such as for violin bows, the second bow ribbon support surface is angled with respect to the first bow ribbon support surface such that, as seen from the frog end of the stick, the bow hair ribbon will appear to twist in a clockwise direction from the frog to the head. In some other applications, the bow hair ribbon will appear to twist in a counter clockwise direction.

Another aspect of the invention features a stringed instrument bow including an elongated stick supporting spaced-apart bow hair clamps, and bow hair held under tension between the clamps, such that a central length of the bow hair is spaced from the stick along a playing length of the bow. The bow hair forms a longitudinally twisted ribbon as held.

In some cases, the twisted ribbon defines a plane twisted about a line that extends between the hair clamps and is contained within the plane. Preferably, the twisted plane defines a total angle of twist, between the hair clamps, of between about 1 and 45 degrees (for example, about 15 degrees).

In some embodiments the stick has a head end and a frog end, and the hair clamps include a first clamp at the head end of the stick and a second clamp carried by an adjustable frog at the frog end of the stick. For some applications, the bow hair ribbon, as viewed from the frog end of the stick, twists in a clockwise direction from the frog to the head end of the stick. In some other applications, the bow hair ribbon twists in a counterclockwise direction.

Another aspect of the invention features a method of tightening a stringed instrument bow. The method includes securing a first end of a bow hair ribbon to a head end of an elongated stick, securing a second end of the bow hair ribbon to a frog mounted to a frog end of the stick (the second end of the bow hair ribbon being secured at an angle with respect to the first end of the bow hair ribbon), and tensioning the bow hair ribbon such that the ribbon is held taught between the frog and the head end and exhibits a longitudinal twist as held.

Yet another aspect of the invention features a frog for use with a stringed instrument bow. The frog includes a stick mount defining a mount axis parallel to a longitudinal bow direction, for mounting the frog on a bow-stick, and a bow ribbon support surface on a side of the frog opposite the stick mount, the support surface defining a hair ribbon plane between two longitudinal edges of the support surface. One longitudinal edge of the support surface is closer to the mount axis than the other longitudinal edge of the support surface.

In some cases, the bow hair ribbon support surface includes a base surface of an elongated groove defined by an underside of the frog.

By "frog" and "head" I refer to the portions of the bow that hold the hair ribbon at spaced-apart points. Such terms are not intended to imply other functional characteristics. For example, it is possible in some bow configurations to hold a hair ribbon taut between two non-adjustable clamps.

The invention can be employed to produce stringed bows for various instruments.

The angle of twist of the hair ribbon along the bow may be selected for the physiology and playing style of a particular musician, and the ribbon twist may be established in one direction for right-hand players, and in another direction for left-hand players. The twist direction may also be reversed for a cello bow, as compared to a violin bow.

The invention may help to reduce muscular and joint stress caused by extensive playing, and may facilitate the playing of certain types of bowings (in particular, spiccato, staccato and sautillé violin bowings), in particular for less experienced players. Experienced musicians may find that this expands their range of sensations while playing, thereby increasing their expressive musical potential. By creating more frequent use of the full hair ribbon, an increase in fullness of sound may be perceived, and the bow hair may be found to wear more evenly, increasing its longevity.

The details of one or more embodiments of the invention are set forth in the accompanying drawings, photographs, and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
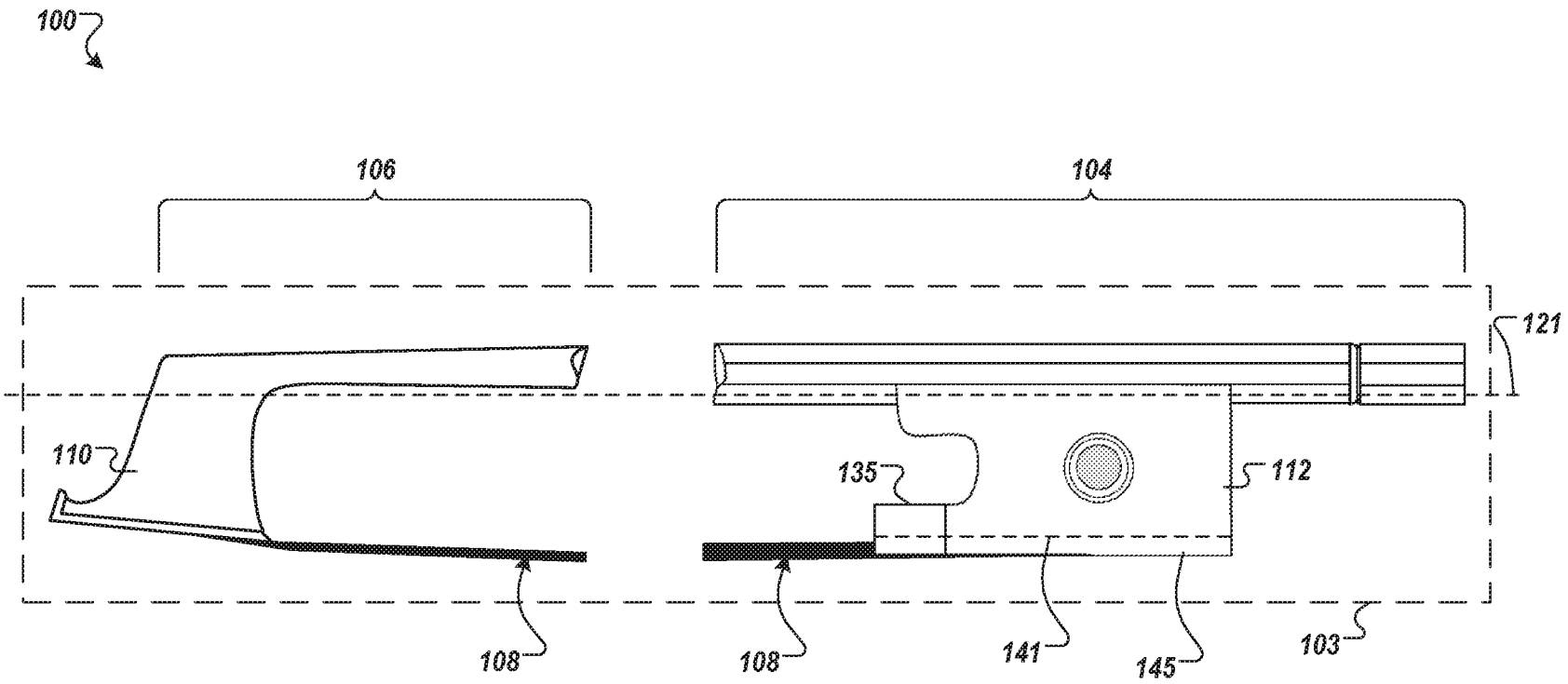
FIG. 1 is a broken side view of a stringed instrument bow.

Referring to FIG. 1, a stringed instrument bow 100 features a bow-stick 102 having a slender, elongated body extending, along a bow plane 103 that longitudinally bisects the body, from a frog end 104 (which is also referred to as the "handle") to a head end 106 (which is also referred to as the "tip"). Stick 102 is designed to be grasped by a user at frog end 104 to maneuver bow 100, such as while playing a stringed musical instrument (e.g., a violin, cello, viola, bass, etc.). The body of the stick is curved inward to create a convex profile, called "camber" which can vary between different implementations. Of course, it would also be possible to use a stick having an elongated body that is substantially straight. The stick can be fashioned from any appropriate type of natural (e.g., Pernambuco wood) or synthetic (e.g., carbon or glass fiber) material. Generally, the precise contour of the stick, as well as the material used to fashion it, can vary without departing from the scope of the present disclosure.

As shown, a continuous ribbon of bow hair 108 (which may also be referred to as a "hank") is held taut between a head 110 positioned at the head end of stick 102 and a frog 112 positioned at the frog end. The bow hair can include a set of natural strands of hair (e.g., horsehair) or a set of synthetic fibers of material (e.g., nylon). The ends of the ribbon (not shown) may be tied, knotted, glued or otherwise tethered to facilitate handling of the bow hair and even spreading of the individual strands.

In this example, the head and the frog each feature a mortise device that functions to secure a respective end of the bow hair ribbon. However, it is envisioned that various other types of fastening systems and techniques can also be used to secure the ends of the ribbon. For example, U.S. Pat. Nos. 2,624,225, 3,759,131, and 4,713,998, the disclosures of which are incorporated herein by reference, describe some alternative types of fastening systems that can be used in conjunction with implementations of the present disclosure.

In any event, as described below, the end of the bow hair ribbon secured by the frog is held at a laterally tilted angle relative to the end of the ribbon secured by the head, such that the ribbon of bow hair is, to some degree, twisted longitudinally along the length of the stick. Specifically, in this example, the surface of the underside of the frog against which the ribbon of bow hair presses when held taut, thereby maintaining its ribbon shape, is fashioned to cant the ribbon at an angle other than perpendicular to the plane containing the bow-stick and ribbon centerlines, while the head end of the bow holds the other ribbon end perpendicular to such a plane. The longitudinal twist of the bow hair ribbon induced by the difference in ribbon angle between its ends unfolds in continuity with the user's natural wrist movement as the arm develops and extends while drawing the bow back and forth. Given the natural trajectory user's arm, such a twist of the bow hair ribbon facilitates keeping the bow hair ribbon in full contact with the strings of the instrument across its width over the course of the pushed and pulled bow draws, which can improve the comfort of playing. This arrangement can also provide more stability to the bow and help performing difficult bow strokes.

Figure 2A:
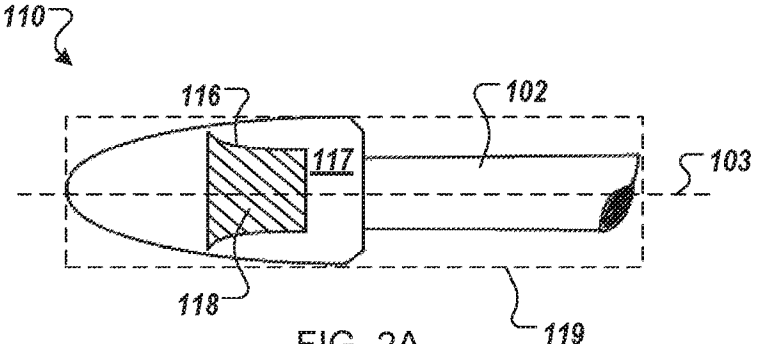
FIG. 2A is a bottom view of the head of the bow of FIG. 1.
Figure 2B:
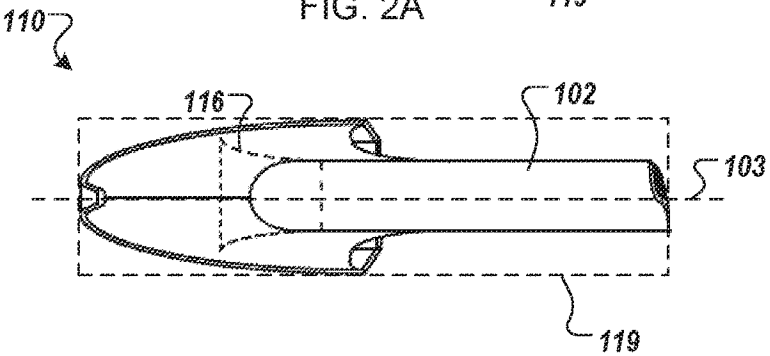
FIG. 2B is a top view of the head of FIG. 2A.
Figure 2C:
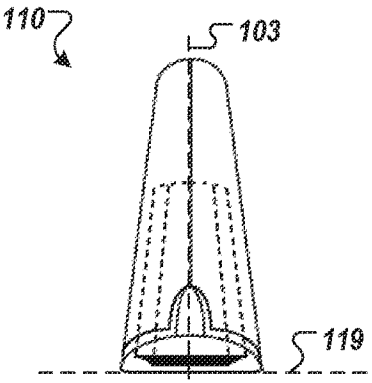
FIG. 2C is a front view of the head of FIGS. 2A and 2B.

FIGS. 2A-2C provide illustrative views of head 110 from various perspectives. The head is carved with a central cavity 116 (mortise) that houses one end of the bow hair ribbon 108. An insert (wedge) 118 is specifically designed to fit in the cavity. Together, the cavity and the insert form a mortise-type clamping device to hold the first end of the bow hair ribbon in place. Typically the head includes an ivory or metal tip at its face, for strength and/or aesthetics. When the bow hair ribbon is secured by the head and held taut on the bow, at least a portion of the ribbon bears against the substantially flat face 117 of the head, orienting the ribbon at one end along a first bow ribbon plane 119 that is horizontally level (i.e., perpendicular to the plane of the bow 103). In this example, the main body of the head extends integrally from the stick, forming a contiguous mass of material. In some other examples, the head can be formed as a separate piece that is subsequently mounted to the stick.

Figure 3A:
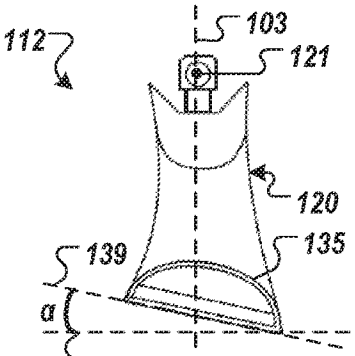
FIG. 3A is a front view of the frog of the bow of FIG. 1, removed from the bow-stick.
Figure 3B:
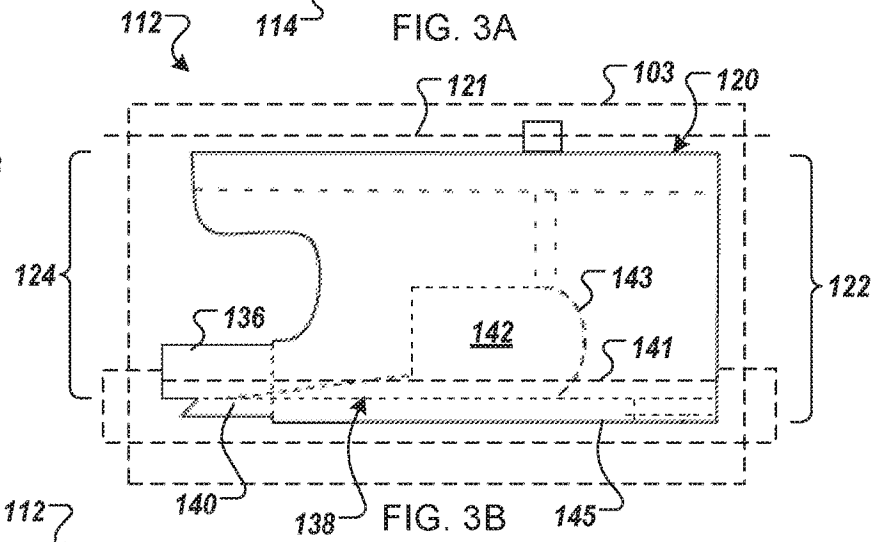
FIG. 3B is a side view of the frog of FIG. 3A.
Figure 3C:
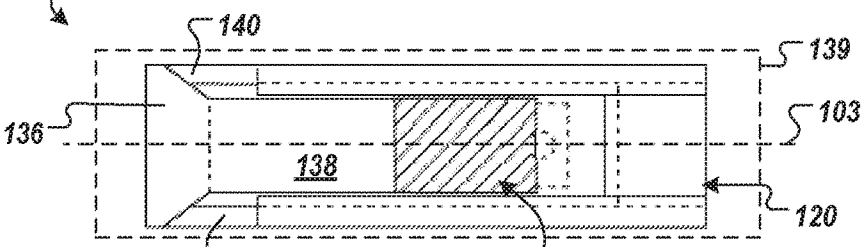
FIG. 3C is a bottom view of the frog of FIGS. 3A and 3B.

FIGS. 3A-3C provide various illustrative views of frog 112. The frog is fitted to the frog end of the bow-stick, using a mount that defines an axis 121 parallel to a longitudinal direction of the bow, and provides a second housing (mortise) for securing the second end of the bow hair ribbon. Its U-shaped front end 124 faces the head of the bow (see FIG. 1). In this example, frog 112 is composed of a monolithic body 120 and various functional parts. The frog is movable along the stick to facilitate tensioning of the bow hair, via a conventional screw-and-button system that results in longitudinal movement of the frog body along the stick. Other tensioning techniques and frog designs, however, can also be used for achieving the same purpose of tensioning the bow hair ribbon.

Referring to FIGS. 1, 2A-2C and 3A-3B, once both ends of the conventional bow hair ribbon are secured in place in head and frog mortises, an inward portion of the ribbon lays flat against the substantially flat base 117 of the head while, on the frog side, a ferrule 135 is adjusted over the tongue 136 to firmly hold in place the flattened bow hair ribbon 108 and evenly spread it outward on the tongue part of the frog. A distal portion of the frog body is designed to secure the second end of the bow hair ribbon. This distal portion of frog body 120 features a semi-cylindrical tongue 136 and an elongated groove 138 leading back from the tongue and having a flat base surface 137. Tongue 136 provides a mount to support a ferrule 135 that is used to spread and firmly hold a portion of bow hair ribbon 108. As shown, the entrance of groove 138 is defined by inwardly projected shoulders 140, which are provided with a taper to define a dove-tailed shape therebetween. The dove-tailed shape of the groove entrance can be designed to receive a spread wedge (not shown) that is held against a portion of the bow hair ribbon by the ferrule. The base of groove 138 gives way to a mortise cavity 142 that is bored into frog body 120. Cavity 142 features an undercut rear wall 143 against which the second end of bow hair ribbon 108 is fixedly held. An insert (not shown) is provided to plug the cavity, effectively clamping the second end of the bow hair ribbon against the rear wall. To secure the bow hair ribbon to the frog, the second end of the ribbon is inserted into the mortise cavity, while an inward portion of the ribbon is laid flat to bear against the base of the elongated groove. The ferrule slides over the outwardly projecting tongue to spread the ribbon evenly along the base of the groove. The insert is wedged into the mortise cavity to secure the second end of the ribbon in place. In some examples, a thin slide piece (not shown) covers the groove to protect the mortise and the bow hair ribbon.

In this example, when frog 112 is properly aligned with bow plane 103, the face of the frog body 120 farthest from the bow-stick is sloped, such that one longitudinal edge 141 of the lower face of the frog body is closer to the mount axis than its other longitudinal edge 145 (see also FIGS. 1 and 3C). At least the portion of the lower frog face that determines hair ribbon orientation is thereby laterally biased at an inclined angle relative to the flat face 117 of head 110. Accordingly, when bow hair ribbon 108 is held taut on the bow, frog 112 orients the second end of the ribbon along a second bow ribbon plane 139 that is laterally tilted at an angle $\alpha$ relative to the first bow ribbon plane 119, along which the first end of the ribbon is oriented by head 110. This arrangement causes the bow hair ribbon to exhibit a measured longitudinal twist along the length of the elongated bow-stick.

Figure 4:
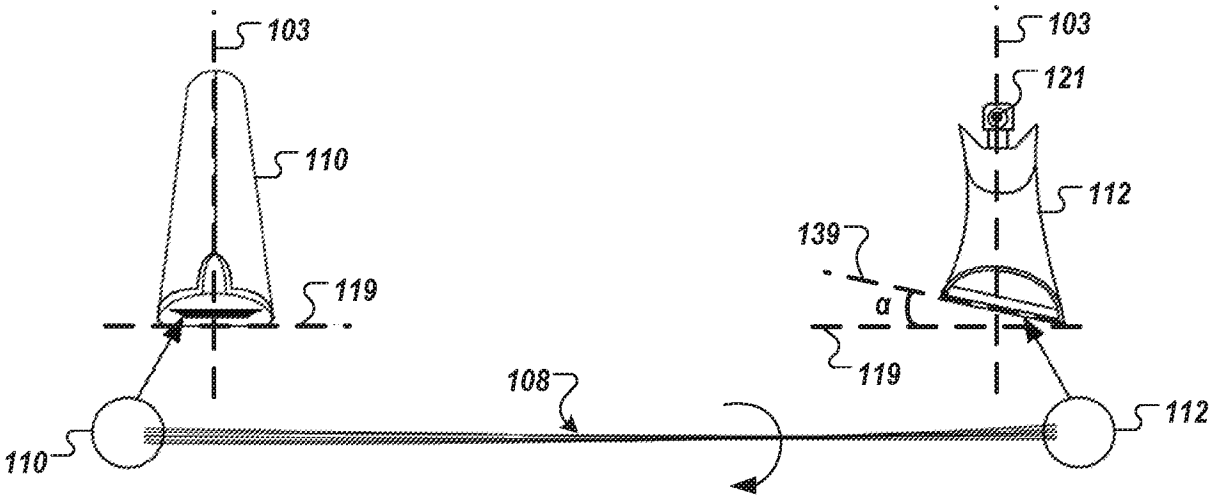
FIG. 4 is a diagram illustrating bow hair ribbon twist induced by canting the underside of the frog.

FIG. 4 provides an illustrative diagram showing the relative orientations of the bow hair at the head and frog of the above described example. As noted above, the lateral tilt of the second bow ribbon plane 139 defined by the frog, with respect to the first bow ribbon plane 119 defined by the head, causes the ribbon to twist along the length of the elongate stick. Geometrically speaking, the ribbon of bow hair defines a plane that is twisted about a line extending between the frog and the head. The angle of twist is equal to the angle between the two bow ribbon planes (in this case, a). As shown, the centerlines of the bow head and the frog, and the longitudinal axis of the twisted bow hair ribbon, all lie in the same plane (the bow plane 103), thereby avoiding bow-stick warping caused by frog misalignment.

As noted above, the twist of the bow hair ribbon is designed to complement the natural twist of a user's wrist as the arm is extended during a playing stroke of the bow. The angle of twist may range from 1 to 45 degrees. The musician may choose a bow configuration with the most appropriate angle in regards to his or her playing style, body disposition and style of bow. For a violin bow, the direction of twist of the bow hair ribbon will typically be such that, looking along the bow hair ribbon from the frog end of the bow, the plane of the ribbon will twist in a clockwise direction, moving from the frog to the head, while for a cello bow, the direction of twist of the bow hair ribbon will typically be in the opposite sense (i.e., a counter-clockwise twist).

Figure 5:
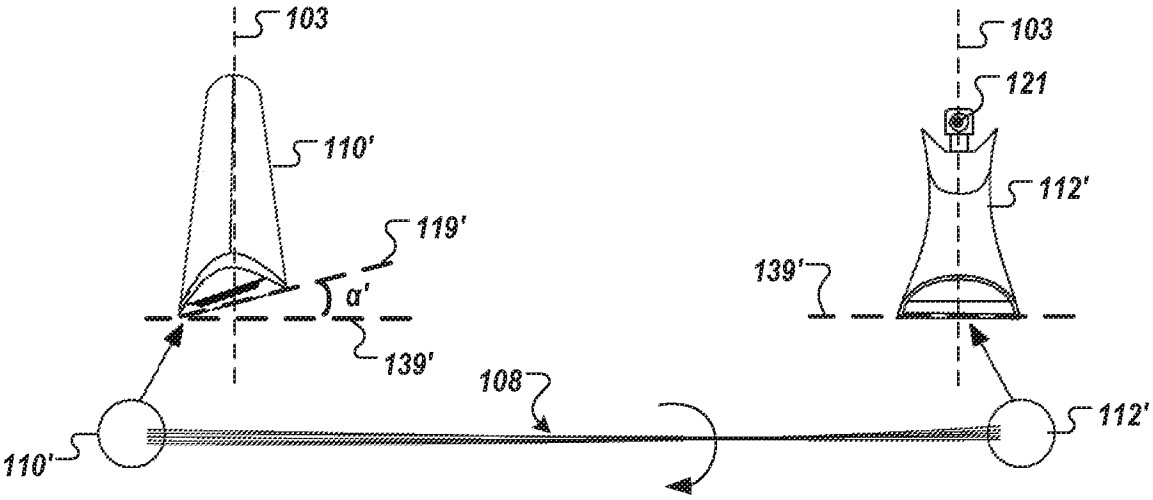
FIG. 5 is a diagram illustrating bow hair ribbon twist induced by canting the underside of the head.

FIG. 5 provides a diagram illustrating another example, where the face of head 110' is tilted relative to the bow plane perpendicular, while the outer surfaces of frog 112' remain perpendicular to the bow plane. In this example, the first end of bow hair ribbon 108' is oriented, by head 110', along a first bow ribbon plane 119' which is inclined by a lateral angle $\alpha'$ relative to the second bow ribbon plane 139' (the bow plane perpendicular), along which the second end of the ribbon is oriented by frog 112. Similar to the previous example, this arrangement causes the bow hair ribbon to become twisted longitudinally when tightened.

Figure 6:
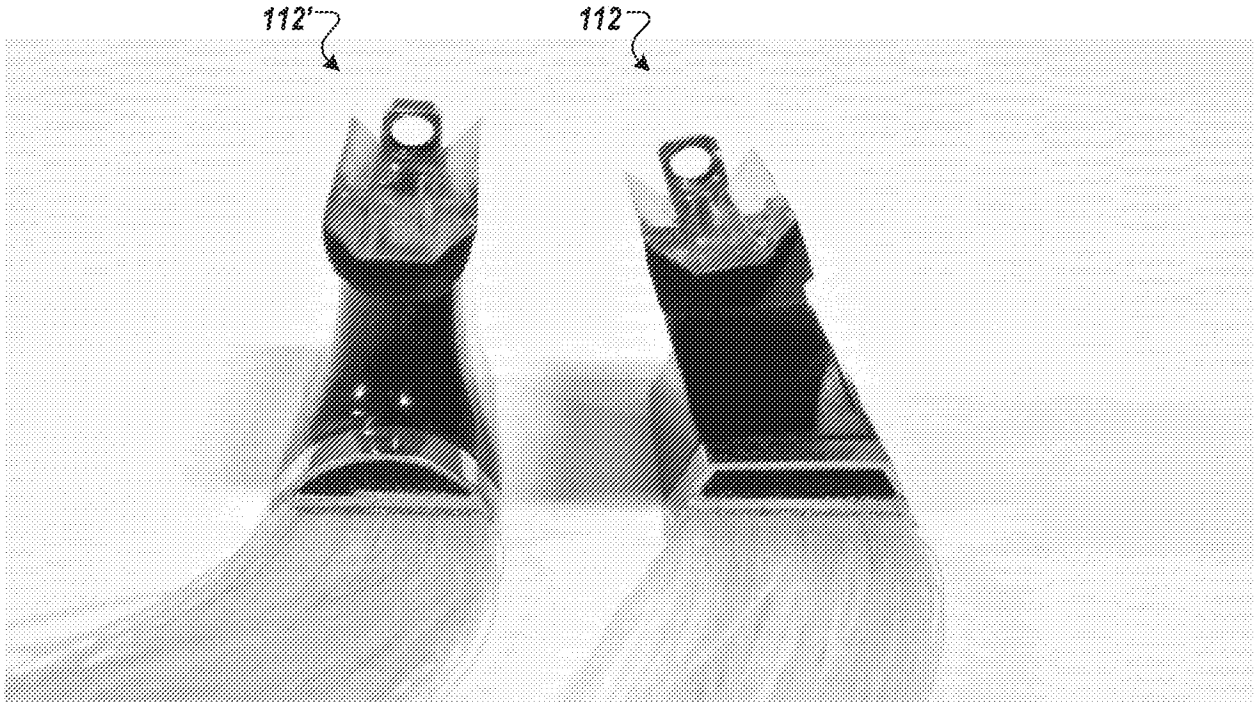
FIG. 6 is a photograph comparing the frog of FIG. 4 and the frog of FIG. 5.

FIG. 6 shows a comparison of the angled frog 112 of FIG. 4 with the standard frog 112' of FIG. 5. A standard bow-stick (i.e., one having a typical head and frog) may be fitted with the angled frog 112 to take advantage of the above described concepts, by simply replacing standard frog 112' with angled frog 112. Such a replacement does not alter the balance point of the bow.

While several examples have been described for illustration purposes, the foregoing description is not intended to limit the scope of the invention, which is defined by the scope of the appended claims. There are and will be other examples and modifications within the scope of the following claims. In particular, it is understood that there are numerous ways to design the bow to secure the ends of the bow hair ribbon that have not been explicitly described herein, but which do not depart from the spirit of the present invention. For example, either end may be adapted to allow the angle of the bow hair ribbon to be adjusted by the player, to achieve a desired hair twist angle.

What is claimed is:

1. A frog (112) for use in a stringed instrument bow (100), the frog comprising:

a stick mount defining a mount axis (121) parallel to a longitudinal bow direction, for mounting the frog on a bow-stick (102); and on the side opposite of the frog from the stick mount, a bow ribbon support surface (137), the support surface defining a hair ribbon plane (139) between two longitudinal edges of the support surface, wherein one longitudinal edge (141) of the support surface is closer to the mount axis than the other longitudinal edge (145) of the support surface; and an elongated groove (138), comprising a flat-base surface and inwardly projected shoulders (140), wherein the inwardly projected shoulders (140) taper to define a dove-tailed shape of the elongated groove.

2. The frog of claim 1, wherein the bow hair ribbon support surface (137) comprises a base surface of the elongated groove (138) defined by an underside of the frog (112).

3. The frog of claim 1, wherein a distal portion of a frog body (120) comprises a semi-cylindrical tongue (136) and the elongated groove (138) leading back from the tongue.

4. The frog of claim 1, wherein the tongue (136) comprises a mount to support a ferrule (135).

5. The frog of claim 1, wherein the dove-tailed shape of the elongated groove comprises a spread wedge.

6. A frog (112) for use in a stringed instrument bow (100), the frog consisting of:

a stick mount defining a mount axis (121) parallel to a longitudinal bow direction, for mounting the frog on a bow-stick (102); and on the side opposite of the frog from the stick mount, a bow ribbon support surface (137), the support surface defining a hair ribbon plane (139) between two longitudinal edges of the support surface, wherein one longitudinal edge (141) of the support surface is closer to the mount axis than the other longitudinal edge (145) of the support surface, and an elongated groove (138), consisting of a flat-base surface and inwardly projected shoulders (140), wherein the inwardly projected shoulders (140) taper to define a dove-tailed shape of the elongated groove.

7. The frog of claim 6, wherein the bow hair ribbon support surface (137) consists of a base surface of the elongated groove (138) defined by an underside of the frog (112).

8. The frog of claim 6, wherein a distal portion of a frog body (120) consists of a semi-cylindrical tongue (136) and the elongated groove (138) leading back from the tongue.

9. The frog of claim 6, wherein the tongue (136) consists of a mount to support a ferrule (135).

10. The frog of claim 6, wherein the dove-tailed shape of the elongated groove consists of a spread wedge.

* * * * *